US006467719B1

(12) United States Patent
Rodriguez

(10) Patent No.: US 6,467,719 B1
(45) Date of Patent: Oct. 22, 2002

(54) APPARATUS AND METHOD OF TURN-UP OF LIGHTWEIGHT PAPER ON HIGH SPEED REELS

(76) Inventor: Peter A. Rodriguez, 13612 McQueens Ct., Jacksonville, FL (US) 32225

( * ) Notice: Subject to any disclaimer, the term of this patent is extended or adjusted under 35 U.S.C. 154(b) by 0 days.

(21) Appl. No.: 09/548,835

(22) Filed: Apr. 13, 2000

(51) Int. Cl.[7] ..... B65H 35/10
(52) U.S. Cl. ..... 242/521; 242/532.3
(58) Field of Search ..... 242/521, 526, 242/532.3

(56) References Cited

U.S. PATENT DOCUMENTS 4,552,316 A * 11/1985 Dropczynski et al. ..... 242/521
5,338,590 A * 8/1994 Rodriguez ..... 428/40
5,467,936 A * 11/1995 Moody ..... 242/532.3
5,810,279 A * 9/1998 Rodriguez et al. ..... 242/521
5,901,917 A * 5/1999 Schmidt et al. ..... 242/521
6,045,085 A * 4/2000 Andersson et al. ..... 242/532.3
6,073,824 A * 6/2000 Gray et al. ..... 242/521

* cited by examiner

*Primary Examiner*—Emmanuel M. Marcelo
(74) *Attorney, Agent, or Firm*—Arthur G. Yeager

(57) ABSTRACT

Web weakening and severing during turn-up of lightweight paper is accomplished by weakening with a plurality of spaced water spray valves to provide a wetting pattern that is determined by web speed, the type of paper being turned up, and the distance between the valve and the web. A series of adhesive supplying valves are spaced to provide adhesive strips to the web between the wetted areas. A programmable logic controller provides for the desired sequence of actuation of the water and adhesive valves. The valves are mounted on a movable frame that extends across the web from edge to edge.

In one embodiment, the adhesive strips are applied behind the wetted areas to allow for a continuous wetted surface across the web. In addition, one or more air valves can be mounted near one or both edges of the web to supply an air blast, which assists the turn-up.

22 Claims, 6 Drawing Sheets

APPARATUS AND METHOD OF TURN-UP OF LIGHTWEIGHT PAPER ON HIGH SPEED REELS

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Filed of the Invention

The present invention relates to the turn-up of lightweight paper involving high-speed reels and spools and particularly to the use of sprayed water and glue to effect the transfer and turn-up of tissue paper, ground wood grades and other paper grades that absorb water readily.

2. Related Art

It is becoming a common practice in the making of tissue paper to split the web into narrow width rolls in order to reduce paper roll handling. In some applications the web is slit using high-pressure water jets. The water jets have to be turned off at the time of turn-up to an empty spool. After the turn-up is complete and the jets turned back on, an operator will use a knife to cut the leading portion of the web that was not cut when the water jets were off. Such an operation is very hazardous and preferably is to be avoided. An improved turn-up apparatus and method will allow for the needed roll handling without potentially dangerous operations.

U.S. Pat. No. 5,338,590 discloses a carrier for both adhesive and water usable as a turn-up tape. Other weakening turn-up apparatus is disclosed in U.S. Pat. No. 5,810,279.

BRIEF SUMMARY OF THE INVENTION

In one aspect of the present invention there is provided apparatus for severing a traveling web of paper and transferring the web to an empty spool comprising a frame extending substantially the width of a web from one edge to another edge, selectively operable web weakening means for weakening a web, selectively operable means for attaching a severed web to an empty spool, each means being mounted to the frame, the web weakening means including a plurality of spaced water applying means for selectively wetting a web at a plurality of spaced locations across a web, and control means for selectively operating the water applying means and the means for attaching. The means for attaching a severed web to an empty spool includes a plurality of spaced adhesive applying means for selectively applying adhesive to a web prior to severing a web. Each adhesive applying means includes a valve selectively operable by the control means for selectively applying adhesive to a web at a plurality of spaced locations. The water applying means and the valves are arranged alternately to provide that the areas of a web that are wetted by the water applying means are located between areas of a web to which adhesive is applied by the valves. The control means operates the water applying means to wet a web before operating the valves to apply adhesive to the web.

The water applying means includes a plurality of water spray valves for wetting a web and the means for attaching includes a plurality of adhesive supply valves for applying adhesive to a web. The water spray valves and the adhesive supply valves are arranged alternately along a width of a web to provide that areas of a web to be wetted by the water spray valves are located between areas of a web to which adhesive is to be applied by the adhesive supply valves. The control means operates all the water spray valves substantially simultaneously to weaken a web across its width. The control means also operates all the adhesive supply valves substantially simultaneously and after the operation of the water spray valves. The control means can also operate the water supply valves sequentially beginning with a first water supply valves sequentially beginning with a first water supply valve adjacent one edge of a web and proceeding to a last water supply valve adjacent another web edge. The control means can also operate the adhesive supply valves sequentially beginning with a first adhesive supply valve adjacent the first water supply valve and proceeding to a last adhesive supply valve adjacent the last water supply valve. The control means may also operate the water supply valves sequentially beginning with both outer water supply valves adjacent respective edges of a web and proceeding to the last water supply valve medially of a web. The control means operates the adhesive supply valves adjacent respective edges of the web and proceeding to the last adhesive supply valve medially of a web. Each adhesive supply valve has two spaced apart outlet orifices to provide for two narrow strips of adhesive to be applied to a web by each adhesive supply valve.

In other aspects of the invention there is provided a method of severing a traveling web of paper and transferring the web to an empty spool comprising the steps of: applying water to the surface of the web at a plurality of spaced locations extending substantially across the width of the web in order to weaken the web at the wetted locations; applying adhesive to the surface of the web at a plurality of spaced locations extending substantially across the web; and winding the web onto the empty spool in a manner to provide force substantially along the width of the web at the weakened wetted locations to cause severing of the web across the entire width of the web from one edge to another edge.

Additional steps include applying adhesive to the web at locations between the locations wetted in step A; applying adhesive to the web after the application of water in step A; applying water to the plurality of locations substantially simultaneously; and applying adhesive to the plurality of locations substantially simultaneously. Further steps include applying water to the plurality of locations sequentially from a location adjacent one edge across the web to another location adjacent the other edge; applying adhesive to the plurality of locations sequentially from a location adjacent one edge across the web to another location adjacent the other edge; applying water to the plurality of locations sequentially from locations adjacent each edge inwardly across the web to a medial location; and applying adhesive to the plurality of locations sequentially from locations adjacent each edge inwardly across the web to a medial location. Additional steps include applying water to the surface of the web in a manner to provide that the wetted locations are contiguous; applying adhesive to the web after step A; and directing pressurized air against a portion of the severed web to force the portion onto the empty spool.

BRIEF DESCRIPTION OF THE SEVERAL VIEWS OF THE DRAWING

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION INTRODUCTION

The present invention consists of providing both a web weakening means and an adhesive means spaced alternately across the lightweight web of paper. The web weakening means consists of a series of water spray valves that provide a wetting pattern determined by web speed, the type of paper being turned up, and the distance between the valve and the web. The water pattern is designed to leave sufficient dry space between the wetted areas to provide that the web has enough tensile strength to carry the web into the nip. The strength provided is similar to the strength of the non-perforated area of a roll of toilet paper.

The volume and pattern of the adhesive applied will be determined by the speed of the web, the type of paper being turned up, the spacing of the water spray nozzles, and the type of adhesive used. The adhesive on the web will spread out at the nip turn-up point and the web will then separate along the wet/dry line across the web.

The apparatus used consists of a movable frame mounted across the web carrying a series of spaced apart specially selected dripless adhesive valves and a series of spaced apart water valves. The adhesive valves and water valves are arranged in an alternate fashion above and across the frame and web.

The adhesive valves are designed for the viscosity of the adhesive and can be electrically operated via a programmable logic controller (PLC) or pneumatically. The water valves may be water only or water and air and are controlled via a PLC or pneumatically. The frame can be removed from the paper machine for purposes of maintenance as required.

System Operation

Figure 1:
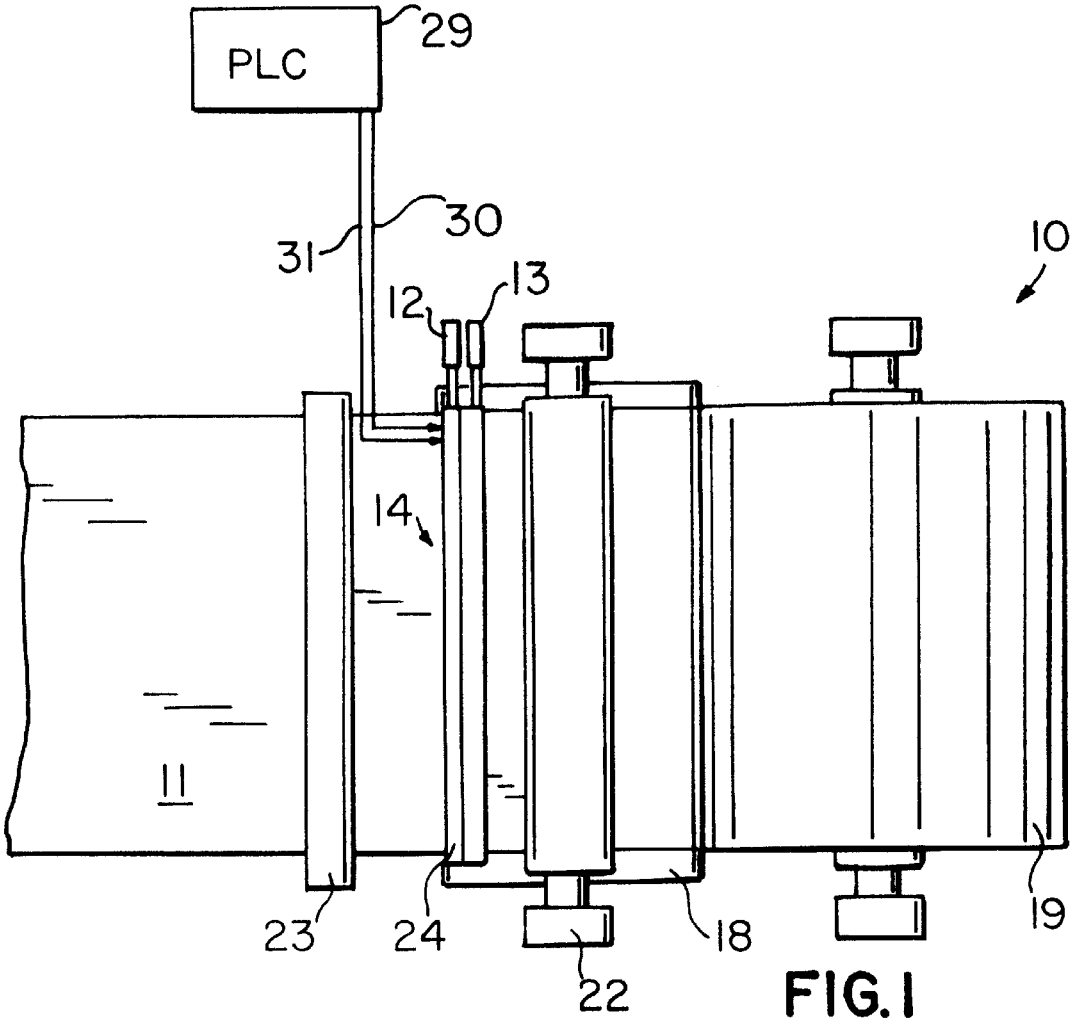
FIG. 1 is a top plan view of a reeling section of a papermaking machine illustrating the placement of the apparatus according to the present invention.

With respect now to the drawings, a top view of a typical installation of the apparatus of the present invention in a papermaking machine is shown generally at numeral 10 in FIG. 1. Light paper web 11 travels past a water supply inlet 12 and an adhesive supply inlet 13 that are mounted to valve support frame 14.

Figure 2:
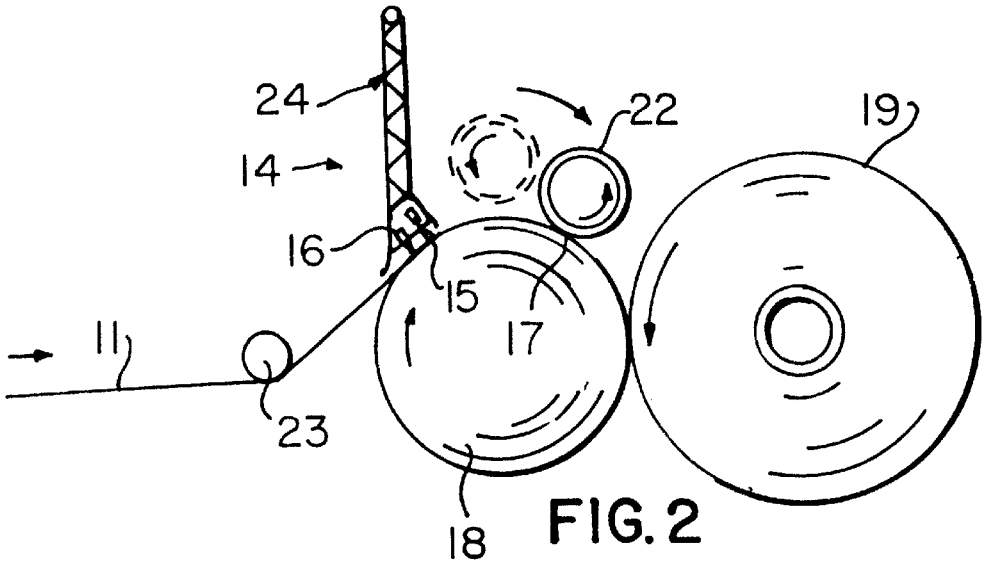
FIG. 2 is a side elevational view of the apparatus of FIG. 1.

As seen clearly in FIG. 2, support frame 14 houses water valves 15 and adhesive valves 16 which are controlled via PLC 29. Nip 17 is formed between empty spool 22 being moved to the turn-up position from its stored position (shown in broken line). Full spool 19 will be moved away from reel drum 18 in the direction of 42 after turn-up so that spool 22 may assume the position of spool 19 after turn-up is completed. The web 11 is directed via lead-in roller 23 to reel drum 18 and then to nip 17. Deflector shield 24 prevents web 11 from flying backwards onto roller 23 in the event the web 11 breaks including a break during turn-up.

Figure 3:
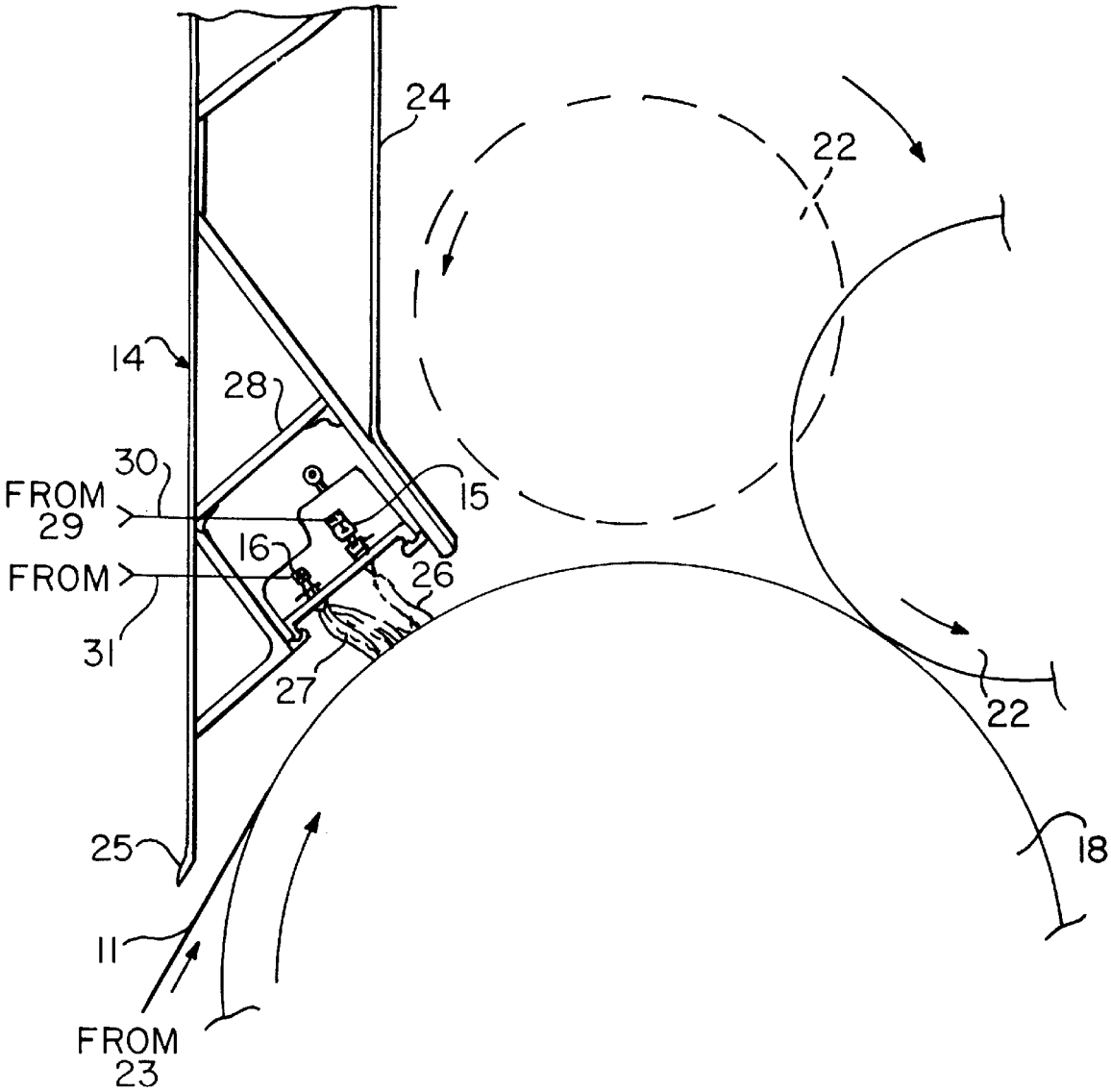
FIG. 3 is an enlarged detail of the apparatus of FIG. 2.

FIG. 3 depicts an enlarged view of the positioning of valves 15 and 16. Spaced water streams 27 are sprayed onto web 11 via water valves and nozzles 16, and adhesive materials 26 are sprayed via spaced adhesive valves and nozzles 15, valves 15 and 16 being alternately spaced over web 11. Air deflector 25 assists in the control of airflow around the valves 15 and 16 to assure proper wetting and adhesive applications on web 1. Housing 28 effectively prevents dust and other debris from fouling valve operation.

With respect now to FIGS. 4–9, the operation of the system can be more readily graphically illustrated with reference also to FIG. 3.

The web 11 travels under the valves 15 and 16 mounted on frame 14, the deflector shield 26 and housing 28 not being shown for purposes of clarity of illustration.

Figure 4:
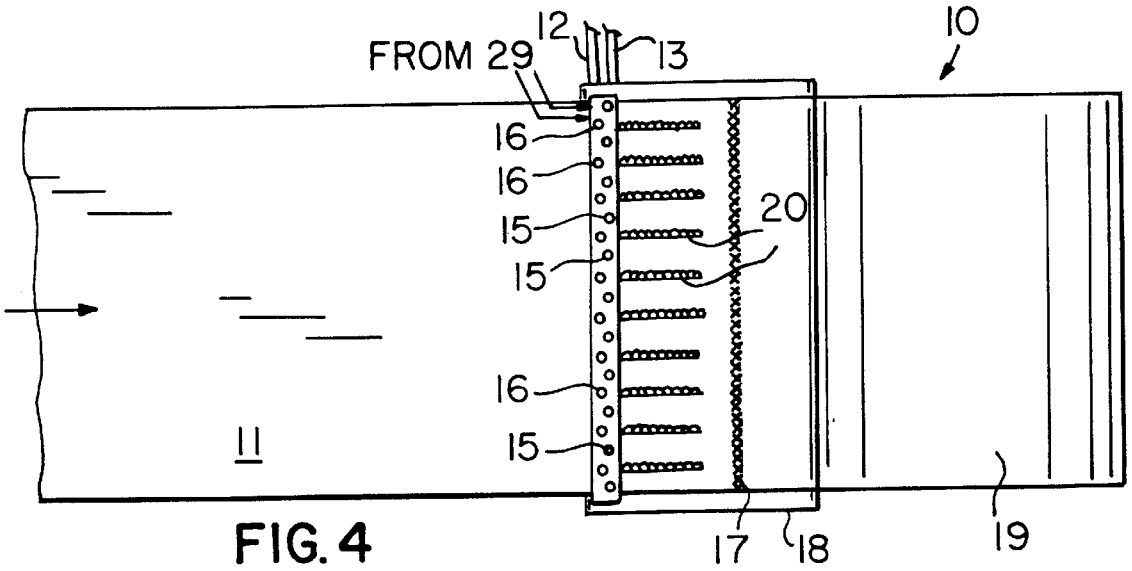
FIG. 4 is a top pictorial view of a portion of the apparatus of FIGS. 1–3 illustrating the wetted portions of a web according to the present invention.
Figure 5:
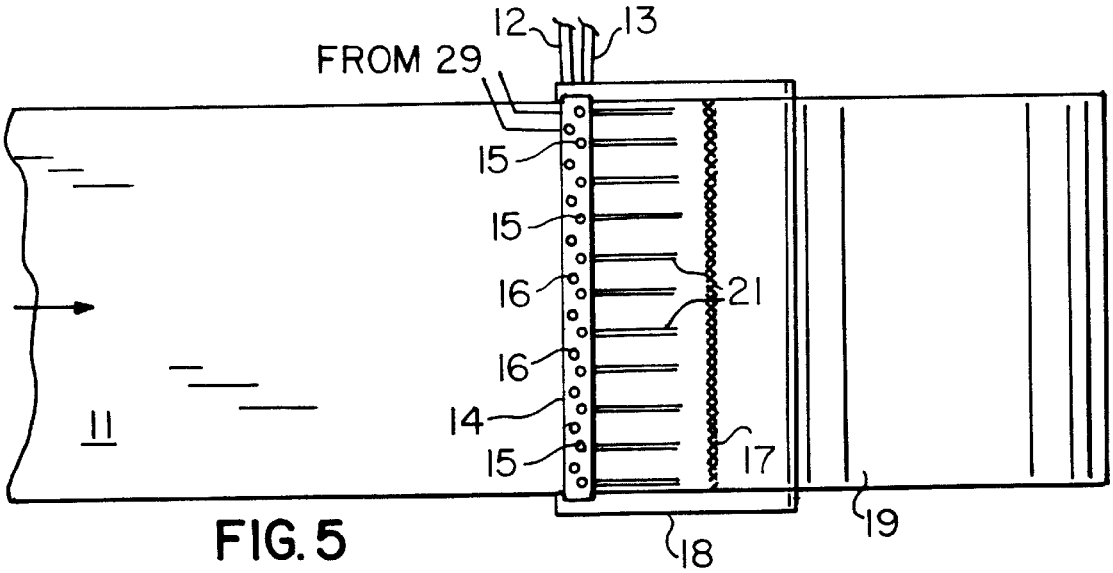
FIG. 5 is a top pictorial view of a portion of the apparatus of FIGS. 1–3 illustrating the placement of adhesive strips to a web according to the present invention.

A command from the PLC 29 activates the water valves 16 to spray water 27 onto the web 11 resulting in spaced wetted areas 20. The width of each area 20 depends on the type of valve 16 sequence used and the length depends on the time each of the valves 16 is activated to its open condition. In the illustration of FIG. 4 all valves 15 are of the same type and are cycled sequentially for a predetermined length of time.

FIG, 5 illustrates the activation of opening of the adhesive valves 15. Adhesive strips 21 are deposited on web 11 and have a width and length dependent upon the speed of web 11, the open time of valve 15 and the characteristics (viscosity and strength), for example, of the adhesive 26 being used.

Figure 6:
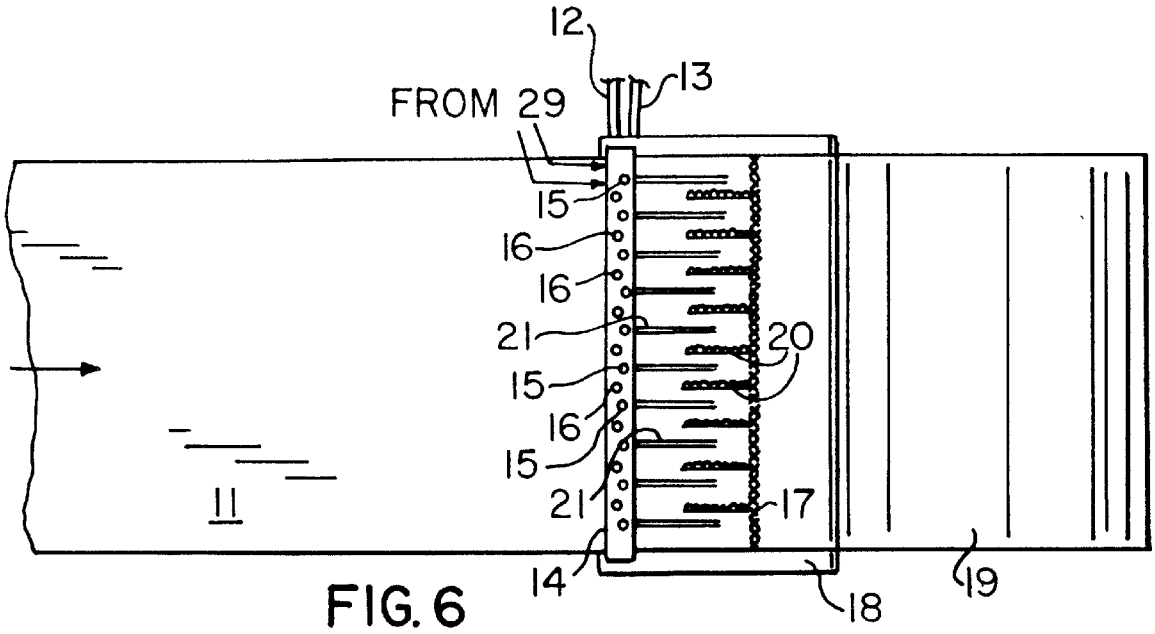
FIG. 6 is a top pictorial view combining FIGS. 4 and 5 and illustrating the relative position of the wetted areas and the adhesive strips according to the present invention.

FIG. 6 illustrates the application of both water 27 and adhesive 26 showing that the wetted areas 20 are preferably created first followed closely by the adhesive strips 21.

Figure 7:
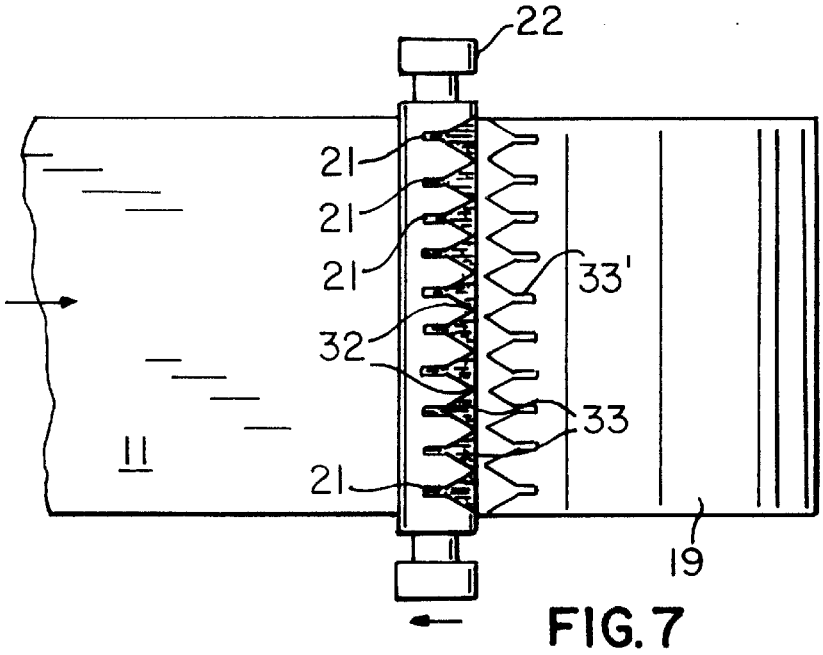
FIG. 7 is a top pictorial view of the turn-up of the leading edge of the web of FIGS. 4–6 severed according to the present invention.

FIG. 7 illustrates the web 11 immediately after turn-up onto empty spool 22. Wetted areas 20 split apart along edge 33' forming a plurality of V-shaped notches 32 and the turned up web 33 is secured to empty roll 22 via spaced adhesive strips 21.

Figure 8:
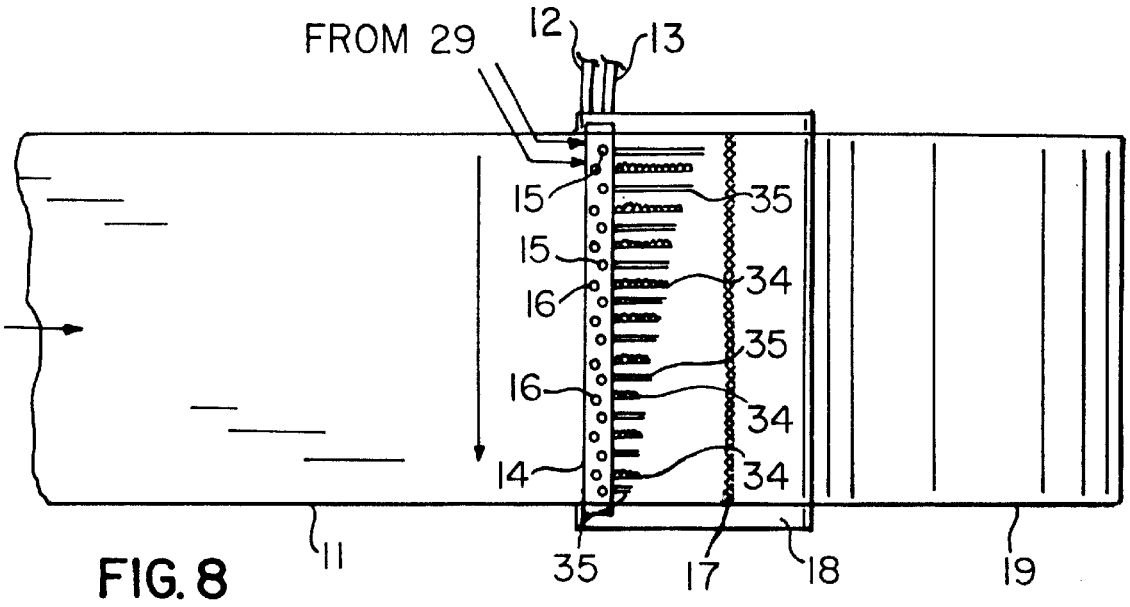
FIG. 8 is a top pictorial view of a second arrangement of the wetted areas and the adhesive strips in accord with the present invention.

FIG. 8 illustrates another manner of creating the weakened water areas and adhesive strips via the PLC 29. Wetted areas 34 and adhesive strips 35 are created on a diagonal or slant with respect to the transverse direction across the web 11 to provide a cross-wise shearing line creating a spiral pattern on the cut over the empty spool that may be more effective than the pattern applied in FIG. 7, depending primarily upon the type of paper being turned up.

Figure 9:
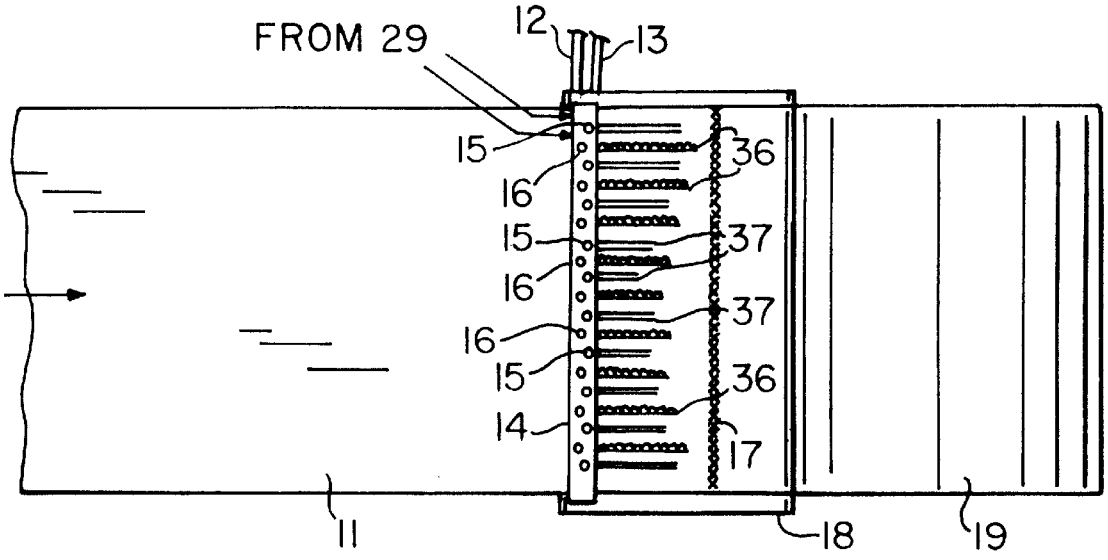
FIG. 9 is a top pictorial view of a third arrangement of the wetted areas and the adhesive strips in accord with the present invention.

FIG. 9 depicts yet another pattern of water and adhesive application according to the present invention wherein the wetted areas 36 are applied first adjacent the outer edges of web 11 and then inwardly in a tapered fashion as shown. Adhesive strips 37 are applied in a similar manner and the paper web 11 tears from each edge with the tear terminating in the middle of the web 11.

In each of the patterns illustrated in FIGS. 4–9, each valve 15 and 16 is individually controlled by PLC 29. The preferred method of operation is to apply water first and adhesive second in each case with certain grades of paper such as ground wood, the water weakening pattern may have to be almost completely across the web 11 in a diagonal manner aided by an initial air blast from one or both edges of web 11, as will be discussed hereinbelow. It is important to note however that due to the higher viscosity and therefore slower flow of adhesive compared to water, a signal to open the adhesive valves 15 may actually be sent from PLC 29 just before the signal to open water valves 16 in order to provide for the proper sequence of wetted areas and adhesive strips applied depends upon machine speed and other variables in a specific application.

Figure 10:
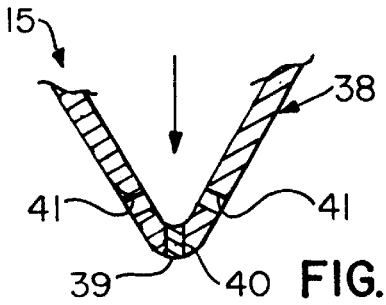
FIG. 10 is a pictorial view of a modified adhesive valve nozzle in accord with the present invention.

FIG. 10 illustrates a preferred adhesive valve and nozzle 15 used in the present invention. The nozzle 38, if it has a central orifice 39, is plugged with plug 40. The nozzle 38 is then cross-drilled to provide two new orifices 41 equally spaced from plug 40 that are preferably identical. The orifices 41 provide for two narrow streams of adhesive rather than a mere spot or a single stream.

Accordingly, adhesive strips 21, 35 and 37 each may be either the result of a single stream of adhesive or two closely adjacent streams of adhesive. The latter strip is preferred and may be achieved by aligning orifices 41 transversely of web 11.

Figure 11:
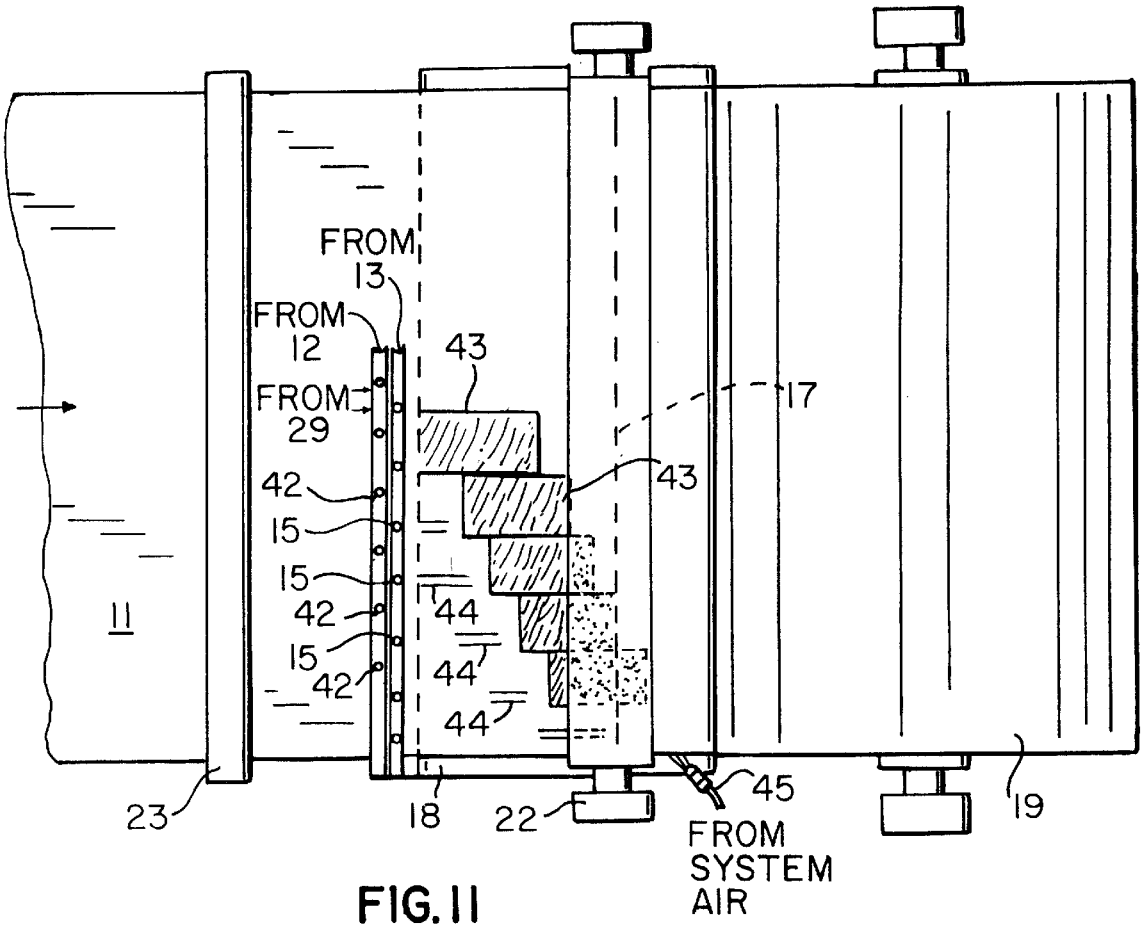
FIG. 11 is a top pictorial view of a fourth arrangement of the wetted areas and the adhesive strips in accord with the present invention.

FIG. 11 illustrates a fourth arrangement of the wetted areas and adhesive strips according to the present invention. Adhesive valves 15 are preferably the valves of FIG. 10. Water valves 42 are the same as valves 16, but have a wider nozzle to provide a wider wetted area 43. The wider wetted areas 43 are useful for a web 11 that may be of "ground wood grades" of paper and similar heavier grades such as that used in towels and napkins where the adhesive strips 44 may not provide sufficient adhesion to lift the web 11 during turn up. FIG. 11 illustrates wetted areas 43 sized and spaced to provide a continuous wetted surface across the web 11 in a diagonal manner. This arrangement provides for adhesive strips 44 behind the wetted areas 43 as clearly shown to wind up the severed web. The time open and sequence of valve 15 and 42 operation is controlled by PLC 29, as is the case in all the illustrated arrangements.

High pressure air valve 45 may also be employed to provide a blast of air against the edge of the web 11 after going through nip 17 in conjunction with adhesive strips 44 to ensure a positive separation of the web 11 during turn up. An additional air valve 45 may be provided on the other side of the web 11 if desired in the circumstances.

While the invention has been described with respect to certain specific embodiments it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. Apparatus for severing a traveling web of paper and transferring a severed web to an empty spool comprising a frame extending substantially a width of a web from one edge to another edge, selectively operable web weakening means for weakening a web, a plurality of spaced adhesive applying means for selectively applying adhesive to a web at a plurality of spaced locations prior to severing a web and after severing a web attaching a severed web to an empty spool, said web weakening means including a plurality of water applying means spaced across a width of a web for selectively wetting a web at a plurality of spaced locations across a web, each said water applying means including a valve, each said adhesive applying means including a valve, each said adhesive applying means and water applying means being mounted to said frame, and control means for selectively operating each said valve of said water applying means and of said adhesive applying means.

2. The apparatus as defined in claim 1 wherein said valves applying water and said valves applying adhesive are arranged alternately to provide that the areas of a web that are wetted by water are located between areas of a web to which adhesive is applied.

3. The apparatus as defined in claim 1 wherein said control means operates said valves applying water to wet a web before operating said valves applying adhesive to a web.

4. The apparatus as defined in claim 1 wherein said control means operates all of said plurality of said valves applying water substantially simultaneously to weaken a web across its width.

5. The apparatus as defined in claim 1 wherein said control means operates all of said plurality of said valves applying adhesive substantially simultaneously and after operation of said valves applying water.

6. The apparatus as defined in claim 1 wherein said control means operates said valves applying water sequentially beginning with a first said valve adjacent one edge of a web and proceeding to a last said valve adjacent another web edge.

7. The apparatus as defined in claim 1 wherein said control means operates said valves applying adhesive sequentially beginning with a first valve adjacent said first valve applying water and proceeding to a last said valve adjacent said last valve applying water.

8. The apparatus as defined in claim 1 wherein said control means operates said valves applying water sequentially beginning with both outer said valves applying water adjacent respective edges of a web and proceeding to the last said valve applying water medially of a web.

9. The apparatus as defined in claim 1 wherein said control means operates said valves applying adhesive sequentially beginning with both outer said valves applying adhesive adjacent respective edges of a web and proceeding to the last said valve applying adhesive medially of a web.

10. The apparatus as defined in claim 1 wherein each said valve applying adhesive has two spaced apart outlet orifices to provide for two narrow strips of adhesive to be applied to a web by each said valve applying adhesive.

11. A method of severing a traveling web of paper and transferring the severed web to an empty spool comprising the steps of:

A. applying water to the surface of the web from a plurality of water nozzles at a plurality of spaced locations extending substantially across the width of the web to weaken the web at the wetted locations;

B. applying adhesive to the surface of the web from a plurality of adhesive nozzles at a plurality of spaced locations extending substantially across the web;

C. winding the web onto a full spool in a manner to provide force substantially along the width of the web at the weakened wetted locations to cause severing of the web across the entire width of the web between its edges, and D. attaching the severed web by the adhesive applied in step B to an empty spool.

12. The method of claim 11 wherein step B includes the step of:

E. applying adhesive to the web at locations between the locations wetted in step A.

13. The method of claim 11 wherein step B includes the step of:

E. applying adhesive to the web after applying water in step A.

14. The method of claim 11 wherein step A includes the step of:

E. applying water to the plurality of locations substantially simultaneously.

15. The method of claim 14 wherein step B includes the step of:

F. applying adhesive to the plurality of locations substantially simultaneously.

16. The method of claim 11 wherein step A includes the step of:

E. applying water to the plurality of locations sequentially from a location adjacent one edge across the web to another location adjacent the other edge.

17. The method of claim 16 wherein step B includes the step of:

F. applying adhesive to the plurality of locations sequentially from a location adjacent one edge across the web to another location adjacent the other edge.

18. The method of claim 11 wherein step A includes the step of:

E. applying water to the plurality of locations sequentially from locations adjacent each edge inwardly across the web to a medial location.

19. The method of claim 18 wherein step B includes the step of:

F. applying adhesive to the plurality of locations sequentially from locations adjacent each edge inwardly across the web to a medial location.

20. The method of claim 11 wherein step A includes the step of:

E. applying water to the surface of the web in a manner to provide that the wetted locations are contiguous.

21. The method of claim 20 wherein step B includes the step of:

F. applying adhesive to the web after step E.

22. The method of claim 11 wherein step C includes the step of:

E. directing pressurized air against a portion of the severed web to force the portion onto the empty spool.

* * * * *